United States Patent [19]

McBride et al.

[11] Patent Number: 4,857,921

[45] Date of Patent: Aug. 15, 1989

[54] DIGITAL TRAFFIC CONTROL SYSTEM

[75] Inventors: William B. McBride; William R. Wilson, Jr.; John C. Tomlinson; John A. McCarthy; Eugene W. Kochanowsky; Jefferson D. Hendricks, all of Tallahassee; Arthur J. Houle, Miccosukee, all of Fla.

[73] Assignee: Flagman, Inc., Tallahassee, Fla.

[21] Appl. No.: 868,997

[22] Filed: May 30, 1986

[51] Int. Cl.[4] ..... G08G 1/07

[52] U.S. Cl. ..... 340/912; 340/902; 340/904; 340/906; 340/907; 340/908

[58] Field of Search ..... 340/912, 902, 904, 906, 340/907, 908, 916, 918, 924

[56] References Cited

U.S. PATENT DOCUMENTS

| | | | |
|---|---|---|---|
| 2,829,362 | 4/1958 | Terrill . | |
| 2,941,185 | 6/1960 | Mullikin . | |
| 3,046,521 | 7/1962 | Cantwell et al. . | |
| 3,159,817 | 12/1964 | Hendricks et al. . | |
| 3,247,482 | 4/1966 | Lesher . | |
| 3,754,209 | 8/1973 | Molloy et al. | 340/912 |
| 3,784,971 | 1/1974 | May | 340/924 |
| 3,867,718 | 2/1975 | Moe . | |
| 3,906,348 | 9/1975 | Willmott . | |
| 4,037,201 | 7/1977 | Willmott . | |
| 4,390,951 | 6/1983 | Marcy . | |
| 4,401,969 | 8/1983 | Green et al. . | |
| 4,463,339 | 7/1984 | Frick et al. | 340/906 |
| 4,573,049 | 2/1986 | Obeck | 340/906 |

FOREIGN PATENT DOCUMENTS 0061963 10/1982 European Pat. Off. .

*Primary Examiner*—Donnie L. Crosland
*Attorney, Agent, or Firm*—Dowell & Dowell

[57] ABSTRACT

A digital control system for controlling the flow of traffic in selected directions in response to digital signals transmitted from a common transmitting control unit to multiple separate receiving traffic control units respectively associated with each controlled direction. The transmitting unit includes a transmitter and digital command code generator operative when actuated to transmit a character in the form of a digital signal specific for one of the receiving units. Each receiving unit includes traffic control indicators operative in different modes of display indications visible to traffic flowing in the direction to be controlled by that unit. Each receiving unit further includes a receiver operative to deliver demodulated characters based on codes transmitted by the transmitting unit, and the codes controlling a microprocessor programmed to process the received characters to initiate command outputs, and logic circuitry connected to receive said outputs and responsive thereto to display traffic control indications as determined by the local unit's demodulated characters, each unit keeping a model of what is being displayed by other units in the system and using it to prevent conflicting traffic control indications.

35 Claims, 7 Drawing Sheets

| TRANSMITTER SIGNAL CODES | | | | | | | | | |
|---|---|---|---|---|---|---|---|---|---|
| IDLE CODE | 1 | 1 | 1 | 1 | 0 | 0 | 1 | 0 | 1 |
| COMMAND A | 1 | 1 | 1 | 1 | 0 | 1 | 0 | 0 | 1 |
| COMMAND B | 1 | 1 | 1 | 1 | 0 | 1 | 0 | 1 | 0 |
| COMMAND C | 1 | 1 | 1 | 1 | 0 | 1 | 0 | 1 | 1 |
| COMMAND D | 1 | 1 | 1 | 1 | 1 | 0 | 1 | 0 | 0 |
| COMMAND E | 1 | 1 | 1 | 1 | 1 | 0 | 1 | 0 | 1 |
| COMMAND F | 1 | 1 | 1 | 1 | 1 | 0 | 1 | 1 | 0 |
| ERROR CODE | 1 | 1 | 1 | 1 | 1 | 1 | 0 | 1 | 0 |

SYSTEM ADDRESS IDEN. CODES FOR THIS TRAFFIC CONTROL SYS.

COMMAND CODES COMMANDING RESPONSES FOR UNITS IN THIS SYSTEM

FIG. 2

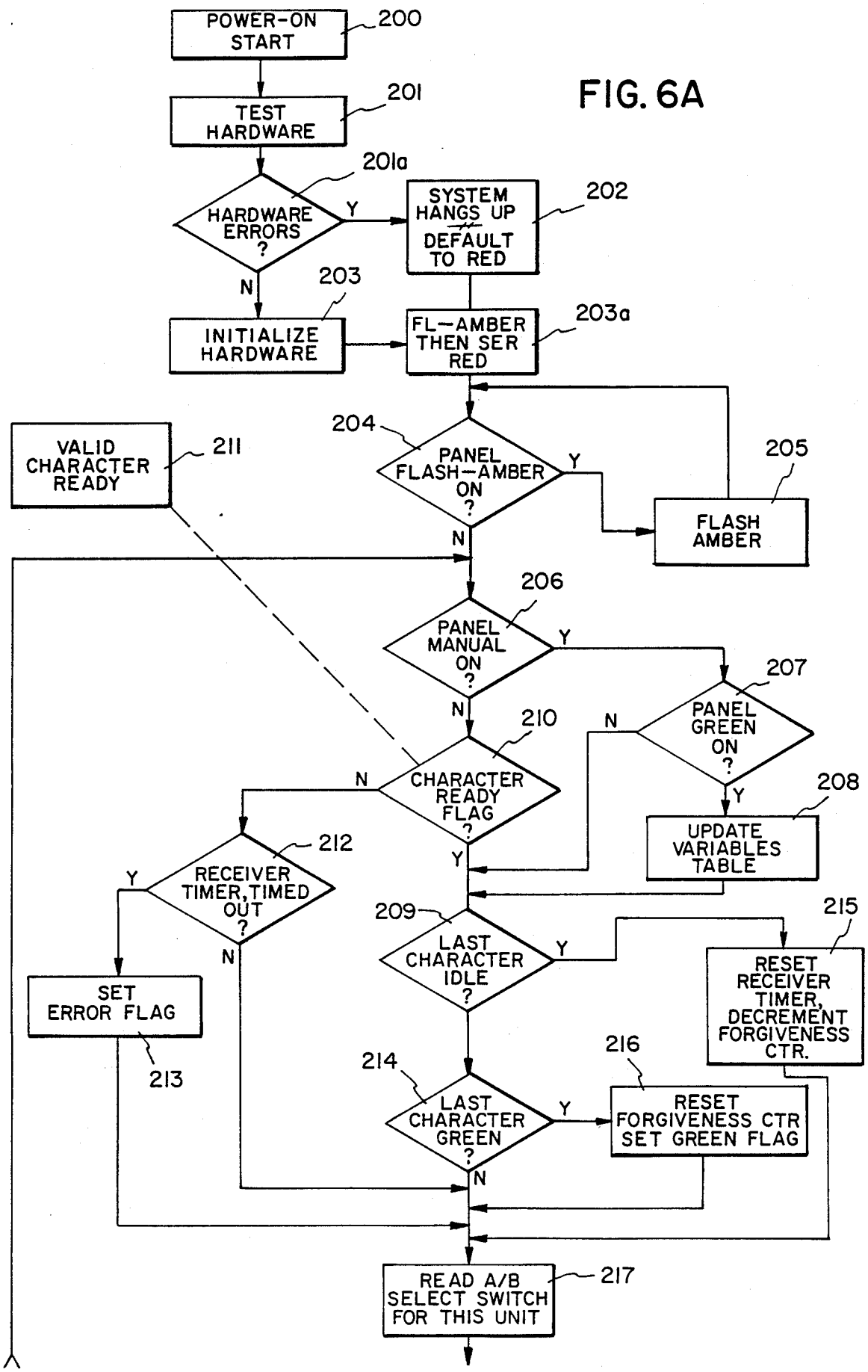
POWER-ON START
200
TEST HARDWARE
201
FIG. 6A
HARDWARE ERRORS ?
201a
Y
SYSTEM HANGS UP
DEFAULT TO RED
202
N
203
INITIALIZE HARDWARE
FL-AMBER THEN SER RED
203a
VALID CHARACTER READY
211
204
PANEL FLASH-AMBER ON ?
Y
205
FLASH AMBER
N
206
PANEL MANUAL ON ?
Y
207
N
210
N
PANEL GREEN ON ?
N
CHARACTER READY FLAG ?
Y
208
UPDATE VARIABLES TABLE
212
Y
RECEIVER TIMER, TIMED OUT ?
Y
209
LAST CHARACTER IDLE ?
Y
215
N
RESET RECEIVER TIMER, DECREMENT FORGIVENESS CTR.
SET ERROR FLAG
213
216
214
LAST CHARACTER GREEN ?
Y
RESET FORGIVENESS CTR SET GREEN FLAG
N
READ A/B SELECT SWITCH FOR THIS UNIT
217

218
SELECT LOCAL UNIT T AS A OR B UNIT
218a
POINT TO A OR B VARIABLES TABLE
219
220
HAS FORGIVENESS TIMED-OUT
Y
221
CLEAR GREEN COMMAND FLAG
N
222
PROCESS THIS UNIT SIGNAL ?
Y
N
223
SET GREEN COMMAND FLAG
224
CLEAR GREEN COMMAND FLAG
225
RECEIVER TIMER, TIMED OUT ?
Y
226
SET OPERATOR FLASH FLAG
N
RESET HEARTBEAT TIMER
227
DECREMENT LAMP MINIMUM TIMER
228
229
LAMP TIMER STILL TIMING ?
Y
N

DIGITAL TRAFFIC CONTROL SYSTEM

BACKGROUND AND PRIOR ART

This invention relates to traffic control systems of the radio controlled type, and more particularly to an improved digital system including a common transmitting unit which communicates with one or more receiving units by transmitting enabling digital characters thereto. The receiving units are respectively coupled to control associated traffic signalling units, each in control of the traffic flowing in a particular direction. The receiving units receive all of the transmitted digital characters, but are respectively programmed to actuate their associated traffic signalling units differently in response to different possible ones of the transmitted digital characters. The receiving units when thus enabled by digital characters actuate their own associated traffic control indication means to display selected indications to the traffic flowing in the direction which the signalling units control. The present digital control system lends itself well to portable traffic control requirements, but is not limited thereto since it can also control other devices, for instance, such as the movements of a crane.

In a typical temporary control situation, for instance at a construction or repair site, the flow of traffic is often limited to a single lane in which traffic flows alternately in opposite directions. In order to substantially reduce labor costs, it is desirable to be able to replace the two flagmen often used in a two-way situation with a single traffic-control system having one operator supervising the flow of traffic using a transmitting unit to actuate remote receiving and signalling units in the system located at the ends of the construction site, one signalling unit for each traffic flow direction, and each remote signalling unit being responsive to outputs from its own receiving unit which receives all of the digital characters radiated as signals from the transmitting unit. There are a number of patented systems using radio control of traffic signalling units.

For instance, U.S. Pat. Nos. 2,829,362 to Terrill Mullikin and 3,046,521 to Cantwell et al show portable traffic control systems used to control either crossed-intersection or alternate one-way single lane traffic, using wired as well as radio controlled techniques. U.S. Pat. Nos. 3,247,482 to Lesher and 3,159,817 to Hendricks et al show the use of radio controlling intersection traffic light systems, the former controlling installed lights by transmissions radiated from an emergency vehicle to ease its way through normal traffic, and the latter showing radio systems for normal control of traffic flow.

Several more recent traffic control patents include U.S. Pat. Nos. 3,867,718 to Moe and 4,401,969 to Green et al. However all of the above prior disclosures are either hard-wired or else radiate unmodulated RF control signals or radiate RF signals modulated with one or more audio tones which are then demodulated and separated by filtering at the receiving units to obtain control information by which their signals are actuated. The latter systems work well enough in isolation from other spurious interfering radiations, but in todays environment where there are so many radio signals radiated for communications and various radio control purposes, the reliability of tone controlled systems is not sufficient to insure proper immunity from accidental wrong responses. Although there exist digital control systems, for instance for garage doors as shown in U.S. Pat. Nos. 3,906,348 and 4,037,201 to Wilmott, no prior disclosure is known that meets all of the requirements for traffic control systems as will be discussed hereinafter.

In addition, here are government regulatory requirements imposed upon all traffic controllers, including portable units. Most of these requirements are imposed by the Manual on Uniform Traffic Control Devices (MUTCD), issued by the U.S. Department of Transportation, Federal Highway Administration. These regulations must be met at all construction and repair sites which are funded in whole or part by federal money. Since such a high proportion of sites involves federal funding, most of the states have adopted the MUTCD regulations as standard for their own, as well as federally funded projects. These regulations are very detailed, and therefore require a more sophisticated radio control system than has been used in the past. Moreover, in order to be sure of meeting these regulations, it is desirable to remove, from discressionary control by the operator handling the system, the full capability of controlling the precise sequence of events, as well as the dwell times of some of the traffic indications so that he can not perform the sequence incorrectly in violation of the MUTCD regulations. The present invention makes many of the function sequences and time durations automatic, and automatically limits many options formerly left to the operator, whereby the MUTCD requirements are always met and failsafe procedures are in all cases carried out to avoid dangerous or confusing indications to oncoming traffic.

The regulations specified by the MUTCD cover almost all phases of traffic control and safety. Among them are regulations including specific requirements that are of particular concern in the present disclosure, for instance specifying for traffic control lights their luminosity, their lens and reflector diffusion patterns, their structural characteristics, the roadway positions and numbers of lights controlling lanes of traffic, requirements for special functions such as flashing caution lights, minimum durations of traffic light displays, etc. These and other requirements will be discussed in more detail hereinafter at locations in this disclosure where the information is particularly pertinent.

In view of the specificity of the MUTCD regulations, it is more practical to buy and use standard traffic light assemblies having government approved physical construction, lenses, reflectors and bulbs, etc., than to alter the light assemblies and bulbs to make them easier to use in portable traffic control situations. When alterations are made, one is then faced with having to obtain approval from the federal government as well as all 50 states. There exists no screw-base D.C. bulb that will replace the approved A.C. bulbs in traffic controller use, while at the same time preserving the required luminosity and the filament position with respect to the reflectors and lenses. Accordingly when the present disclosure is used in the form of a portable unit it is necessary to provide a 110 volt A.C. power source to supply the lights themselves, thereby making a special configuration of portable power supply necessary.

THE INVENTION

This invention comprises an improved digital control system having visual traffic signalling controllers for directing the flow of traffic in one or more flow directions in response to digital signals selectively transmitted from a common transmitting unit in the hands of an operator, the signals comprising digital characters radiated to different receiving units respectively associated with the several signalling controllers and traffic directions. The transmitting unit includes a transmitter, an FSK modulator, and a digital character generator. The character generator is capable of generating at least one COMMAND character corresponding with each different receiving unit, an IDLE character indicating that the system is ON but that no command is being transmitted, an ERROR code, and a digital system address indicating that the characters being transmitted are addressed to this particular system of units. When the transmitter is activated, it begins to send the IDLE character, periodically transmitting it in short pulses to conserve transmitter power. A manual selector is controlled by the operator to select a COMMAND character specific to a selected one of the remote receiving units and to which a selected remote unit is responsive to command its associated signalling unit. The ERROR code character is transmitted if the operator should accidentally attempt to send more than one COMMAND character at a time.

Each receiving unit comprises a receiver, a digital-signal demodulator connected thereto and operative to deliver demodulated characters, a system address comparator which delivers a VALID transmission signal when the address code matches, a microprocessor with random access memory (RAM) means to store and maintain the current operational state of the various remote receiving units, and read only memory (ROM) means operative to program the microprocessor to respond appropriately either to received digital characters or to the failure to receive any such character. The microprocessor responds by delivering appropriate binary outputs to logic means which are connected to receive said binary outputs and which are responsive thereto to deliver control outputs to control the traffic control indication means, which may comprise either GO, CAUTION and STOP signals, or alternatively may comprise alphanumeric displays, such as "MERGE LEFT", etc. The multiple receiving units are all tuned to receive all of the radiated binary signals from the transmitting unit, and respectively to demodulate them to recover the associated COMMAND character being currently transmitted. The ROM means in the multiple different receiving units operate to program the associated microprocessors to maintain in the RAM means tables of variables indicating the commanded mode of each receiving unit, so that a receiving unit in response to a command will actuate its logic means and associated signalling means to display the appropriate traffic control indication called for by that command, but only after checking the variables for the other receiving unit, or units, in the system to ensure that the mode commanded for this unit will not be in conflict with that of any other unit. The display is maintained as long as the COMMAND character persists, and for an appropriate interval thereafter as determined by timer means to prevent accidental rapid reversal of traffic indications. In the preferred embodiment each receiving unit will actuate its logic means and signalling means to display a STOP indication in response to receiving no COMMAND at all, or non-enabling character, and will actuate the logic means and signalling means to display a GO indication in response to receiving a COMMAND character specific to that unit. In this embodiment the signalling means also includes a CAUTION indication, and is programmed automatically to step from GO to CAUTION to STOP upon loss of its COMMAND character. More specifically the ROM means in each receiving unit programs the microprocessor in response to the loss of its COMMAND character to delay the automatic step of its binary outputs from GO indication to CAUTION indication for a predetermined interval to permit re-acquistion of its COMMAND character if only momentarily lost, and then to step to a CAUTION indication. The receiving units have timer means therein serving to establish said predetermined time interval and also a dwell interval for the CAUTION indication, which dwell is manually selectable by a DIP switch. At the end of the dwell interval the display changes to a STOP indication which remains until a new COMMAND character specific to that unit is again received and demodulated after the ROM means assures that a sufficient STOP interval has passed for all signaling means to present a valid combination of displays. The ROM means in each receiving unit is operative to program the microprocessor in response to the loss of all digital signal input to the unit to retain a STOP indication for a predetermined waiting interval after again receiving a digital signal input comprising a character, the length of the waiting interval being at least as long as the time interval required for another receiving unit to step the outputs of its microprocessor and logic means from an existing GO indication through a CAUTION indication to a STOP indication. The receiver logic means comprises multiple gates connected to be responsive to the binary outputs of the microprocessor, and ensures that no more than one signal indication is activated at a time at the local unit. Each receiving unit further includes a low-voltage circuit and a circuit responsive to cessation of the cycling of the microprocessor, the circuit actuating the microprocessor to continuously display a STOP mode indication. Each receiving unit is further provided with manual switch means operative to continuously flash the CAUTION indication while the switch means remains actuated. A typical signalling means includes light bulbs energized in response to control outputs from the logic means, and further includes a DC OPERATOR light located on each traffic light controller assembly so that it faces rearwardly thereof toward the operator, the OPERATOR light being energized in a steady ON mode when the GO display is energized and being energized in a flashing mode when the receiving unit receives no VALID signal or ERROR code. In the practical embodiment triacs are coupled to the bulbs to control energizing thereof, and a transistor is coupled to the operator indicator to control energizing thereof. The triacs and transistors have control electrodes which are coupled through opto-isolators to the outputs of the logic means. The controller bulbs are supplied with 110 volts A.C. either from the power mains or, in the case of a portable system, from a battery through an inverter. In portable systems, the alternator is used to charge a battery which in turn powers the its own receiving unit. The system's transmitting unit is powered by a self-contained rechargeable battery. In portable systems, each remote receiving and signalling unit is supported on a frame carrying standard traffic light controller assemblies mounted on an arm extending above the frame, which also supports the battery, engine generator, inverter and electronics including the receiver and the microprocessor and logic means. The frame can itself be wheeled or transported on a mobile trailer of suitable design.

OBJECTS AND ADVANTAGES OF THE INVENTION

It is a principal object of the invention to provide an improved digital traffic control system for transmitting command characters to the receiving and signalling unit for each traffic direction, the system using in each receiving unit a microprocessor programmed by ROM means, and RAM means useful, inter alia, for storing a table of variables for the local unit and for each remote unit, these variables representing the state and display mode of the local unit as well as the state and display mode of the remote unit or units in the system so that the local microprocessor not only recognizes and correctly responds to transmitted COMMAND characters specific to the local unit, so that the microprocessor in each receiving unit compares the variables in the local and remote units' tables before commanding a change of the local traffic control indication to avoid the display of any conflicting indications.

It is another major object of the invention to provide a digital control system in which digital signals carrying the command characters also carry a system address code, which must be compared and recognized at each receiving unit to produce a VALID signal, whereby to provide a very high degree of immunity in the receiving units to spurious signal responses and to virtually eliminate any incorrect and possibly dangerous traffic signalling indications.

A further very important object of the invention is to provide a programmed microprocessor system which is fail-safe in the sense that upon signal failure, i.e. loss of transmitted COMMAND character together with a VALID address signal, the receiving and signalling unit automatically cycles through appropriate traffic signal indications, while observing minimum times for the various traffic indications, and proceeds to a STOP mode until a VALID transmitted character is again received. In addition, a time delay is automatically provided to delay a receiving and signalling unit which is currently displaying a GO signal from cycling immediately to CAUTION and then to STOP. The delay lasts a predetermined interval before exiting the GO mode, during which the receiving unit may re-acquire a green COMMAND character, so that a momentary interruption or distortion of its signal by outside interference, or by the operator's finger slipping accidentally off the control button, will not begin an undesirable and possibly confusing sequencing from the GO mode for display to approaching traffic. This delay interval is provided by ROM program and RAM storage, and is referred to hereinafter a the forgiveness counter.

Another similar object of the invention is to provide a programmed microprocessor system which automatically provides a waiting interval during which a receiving and signalling unit which has been displaying a STOP mode can not be cycled to a GO mode, whereby the operator can not accidentally immediately change from STOP to GO without allowing the other signalling unit time in which to cycle through the delays contained in its programmed GO to CAUTION to STOP sequence, the said waiting interval being at least as long as that cycling routine, and preferably somewhat longer to give the controlled right-of-way time in which to be cleared of vehicles.

Still another major object of the invention is to provide a microprocessor system which is controlled by ROM means which is of the electrically programmable type, whereby the system is provided with flexibility so that it can be reprogrammed to accomplish various different purposes: for example, controlling traffic at different types of roadway configurations, changing the delay and waiting intervals for the sequencing, or changing the types of traffic controller displays, for instance, GREEN, AMBER, RED versus alphanumeric displays.

A further desirable object of the invention is to provide a programmed microprocessor system which has the capability within its program to check for low supply voltage, for failure of the program to cycle regularly, etc., and to take appropriate action in certain cases.

A very important object of the invention is to provide a programmed microprocessor system in which the operator of the system, using the transmitting unit, has few control options and therefore very little capability of making errors that could cause dangerous traffic situations. In most of the prior art systems, the operator is free to select optional traffic indications at will. This is a disadvantage because he may become confused and call for dangerous combinations of signals. In the present digital system, during normal traffic control, the operator has only three options, i.e. to do nothing in which case all units continue, or change modes to display STOP commands; or to operate the selector switch means to begin a commanded response that will move traffic in one controlled direction; or to operate the selector switch means to begin a commanded response that will move traffic in the other controlled direction. There may of course be more than two controlled directions. However, the point is that whatever the operator does, the response of the system, including its automatic sequencing and accompanying delays and waiting intervals, will be a safe and orderly succession of signals.

Other objects and advantages of the invention will become apparent during the following discussion of the drawings:

BRIEF DESCRIPTION OF THE DRAWINGS

FIG. 2 is a table showing typical encoded digital signals suitable for transmission from the transmitter unit to receiver

FIGS. 6A, 6B and 6C, when read together, form a composite Figure which shows a flow diagram of the microprocessor program.

DESCRIPTION OF A PREFERRED EMBODIMENT OF THE INVENTION

Figure 1:
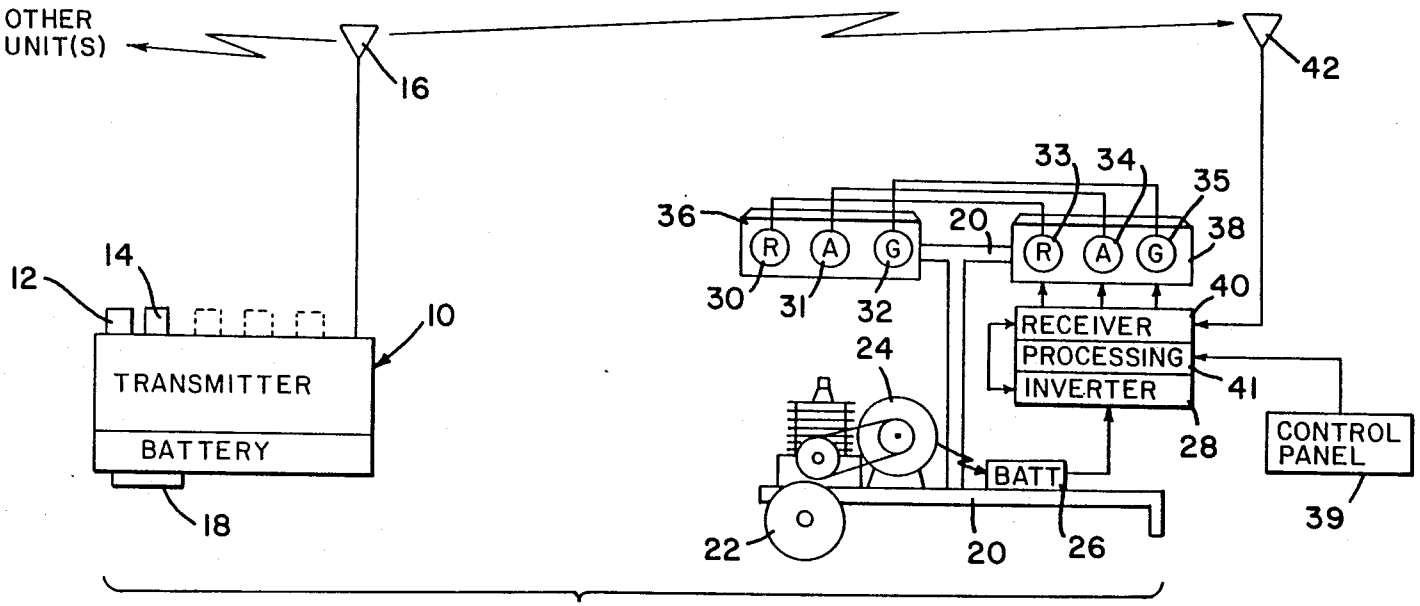
FIG. 1 is a block diagram of a traffic control system embodying the invention and showing a transmitter unit controlling a remotely located traffic controller unit.
Figure 3:
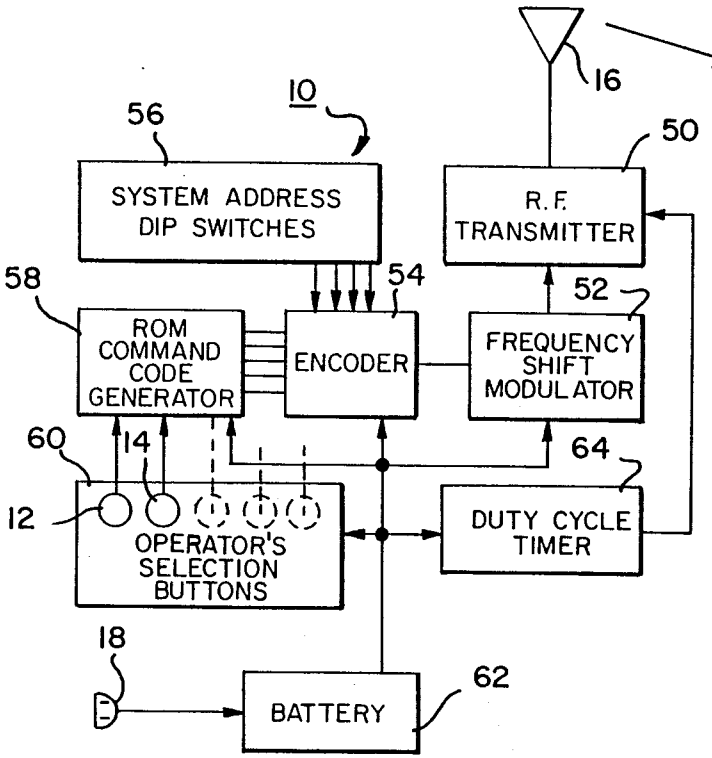
FIG. 3 is a block diagram of a transmitter and digital and address generator unit according to the invention.

Referring now to the drawings, FIG. 1 shows the over-all components of a system for controlling traffic using standard traffic controller lamp units with commanded by a transmitting unit and including cooperative receiving and signal processing units, and a power supply suitable for portable mobile use. The transmitting unit 10, shown in greater detail in FIG. 3, is a hand-held box having push buttons including buttons 12 and 14 for manually selecting operator commands, and having an antenna 16 by which encoded digital signals are transmitted to one or more distant receiving units of the same system each associated with a signal processing and traffic controller unit. The transmitting unit 10 has a plug 18 on the side of it through which its internal battery can be recharged.

Figure 4:
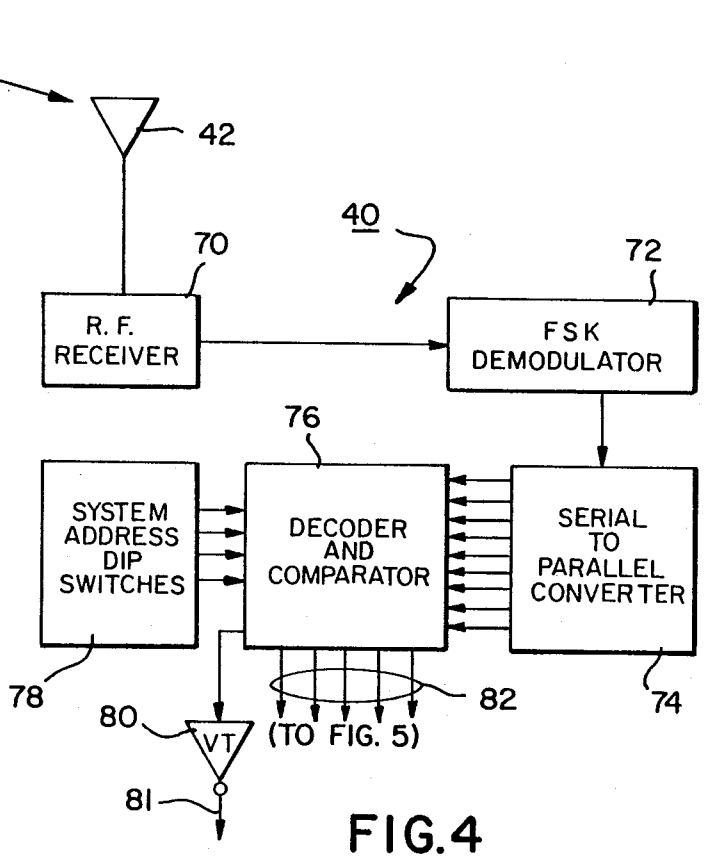
FIG. 4 is a block diagram of a receiver and signal decoder unit and address comparator according to the invention.

FIG. 1 further shows the receiver and decoder 40, shown in greater detail in FIG. 4, and shows a signal processing unit 41 and a pair of traffic controller signaling units 36 and 38 which are carried on a frame 20 having ground engaging wheels 22. The frame supports an engine/generator or alternator 24 which continuously charges a storage battery 26. In turn the battery drives an inverter 28 which inverts the output voltage of the battery and delivers 110 volts AC to energize the traffic controller unit lamps 30, 31, 32, 33, 34 and 35, which are part of two standard traffic controller units 36 and 38, which are purchased units complete with government approved lenses, reflectors, electrical lamps and sockets. These will not be further described herein. The receiver and decoder unit 40 is tuned to receive through its antenna 42 the encoded characters and address radiated by the transmitter unit 10. The decoded characters are fed to the data processor 41 which accepts them if accompanied by a VALID address signal and controls the flow of power from the inverter 28 to selectively energize the lamps 30–35 of the controller units 36 and 38, in a manner which will be more fully described hereinafter. A control panel 39 supports switches which are described hereinafter in connection with FIG. 5, and which permit the traffic controller lamps to be locally controlled manually, as distinguished from being remotely controlled by the transmitter unit.

The transmitter unit normally remotely controls multiple traffic controller units within its own operating system by radiating to them digitally encoded signals, which are then decoded to determine the display modes to which their traffic control indicators are being commanded. FIG. 2 shows a table of typical encoded digital signals, each of which is nine bits in length and includes four bits which are called system address bits, and which indicate to a receiver unit that this signal is in fact radiated from the system's own transmitter, instead of a nearby transmitter in another traffic control system. In addition, each digital signal includes five more command bits which deliver a message to all of the receiver units of the system. As can be seen in the table of FIG. 2, the system address bits for this illustrative system include in each digital signal four ones. Thus all of the remote controller units in this system will be responsive to signals having four ones in the system address bit positions, and non-responsive to incoming signals differently encoded in these four bit positions. Referring now to the five command address bit positions, the uppermost code having the last five bits 00101 is referred to as an IDLE character, which indicates to all of the receiver units that the transmitter is ON but idle. In the idle condition, all traffic controllers should be showing red. The second code entitled COMMAND A has a different succession of command bits 01001, and this code is received by the all the receiver units, but commands only the display at the receiving unit A, which has been selected as the A unit manually by the operator of the system as will be discussed hereinafter. This COMMAND A digital signal is specific to unit A, commanding it to change to the GO mode. This same command is also received in the other units, but does not cause them to change their traffic light display modes, although it is registered in each other unit as having placed unit A in the GO mode. Likewise, the COMMAND B comprising bits 01010, when transmitted will command remote unit B to the GO mode, and it is also received in the other units causing them to register that unit B is commanded to the GO mode.

In this illustrative embodiment, only two units A and B will be discussed for the sake of simplicity, but obviously additional units can be included in a system. The COMMANDS C, D, E and F codes shown in FIG. 2 would be used to command such additional units (not shown). The additional commands may in fact merely comprise more signalling functions at existing remote units. For example, the COMMAND C character when transmitted might be selected to control an additional function located in unit A, such as a left turn light function. Thus unit A might respond to a COMMAND A character to light its straight-ahead GO light, but might respond to a COMMAND C character to light its left turn arrow light, or to light both its straight-ahead GO light and its left turn arrow lights together. Of course, many possible combinations of these commands can be envisioned. The electronic chips currently employed in the production model can handle multiple commands as shown in FIG. 2 to control a like number of functions. The final data word is an ERROR code transmitted by the transmitter whenever an operator accidentally presses several different command buttons simultaneously, as will be discussed hereinafter.

Referring now to the block diagram of FIG. 3, which shows the transmitter and encoder unit 10, this unit comprises in the preferred embodiment a frequency-shift keed (FSK) transmitter 50 which is modulated by a suitable FSK modulator 52. The modulation comprises digital codes generated by an encoder 54, which encodes the complete nine bit digital signals as are shown in FIG. 2. The four system address bits, all ones as shown in FIG. 2, are encoded by four DIP switches 56 which are manually set by the operator of the system. These settings should match the settings of four similar DIP switches 78 which are included at each receiver and coder unit as will be described hereinafter with reference to FIG. 4. The five bits representing the COMMAND, IDLE and RROR codes shown in FIG. 2 are generated in a read-only memory ROM) chip 58 which is the command code generator. This chip has all eight codes programmed into it, and it delivers an appropriate code depending on the status of the push buttons, i.e. the buttons 12 and 14 on the operator's selection panel 60. In button is pushed, the IDLE code in FIG. 2 continues to be sent If one of the buttons is being pressed such as the button 12 or 14, or other button if there are more, then the command code generator 58 will send the five bits of the appropriate COMMAND code to the encoder 54. If by accident plural button are pressed, then the ERROR code bits will be sent. In all events, the encoder 54 serializes the system address bits together with the command bits and delivers the complete nine bit ode as shown in FIG. 2 to the FSK modulator 52.

The transmitter unit 10 is usually powered by its own battery 62. Therefore. especially in the case of a hand-held portable unit, it is very desirable to conserve battery power during use and between recharges of the battery through the plug 18. The transmitter unit is ON at all times during normal use, because when it is no sending a COMMAND character, it is sending the transmit IDLE data code. In order to conserve battery power, the tranmitter unit 10 has means for intermittently powering the transmitter using a duty cycle timer 64, which powers up the transmitter during only about 30% of its ON time. Thus, periodically, about once every 400 milliseconds, the timer 64 places battery power on the transmitter and triggers the data to decode and deliver a digital signal to the modulator 52. As a result, the several receiving and controller units A and B receive transmitted encoded signals at regularly timed intervals. Mean are provided in the remote units to anticipate the inter as between transmitted signals and to react appropriately to any failure of the transmitter signals which would result in loss of any transmitted VALID encoded signal for longer intervals of time as will be described hereinafter. The data words transmitted via the antenna 16 are serial FSK signals, of course, are received serially at the receiver and decoder unit 40.

The receiver and decoder unit 40 is shown in FIG. 4, and comprises an RF receiver 70 receiving the transmitted signal at its antenna 42. The receiver 70 in turn feeds into an FSK demodulator 72 which modulates the shifted frequencies and recovers serial bits therefrom and feeds them into a serial to parallel converter 74 which then feeds the nine bits in parallel into a decode and comparator 76. Four DIP switches 78 are also connected to this decoder/comparator 76, and these DIP switches are preset b the operator to match the system address DIP switches 56 in the transmitter unit. The decoder and comparator 76 compare the four system address bits coming from the receiver with the settings of the DIP switches 78. If they match, the signal just received is a valid transmission (VT) and a VALID transmission signal 81 is output from an amplifier 80 to the processing system 1, which is shown and described in greater detail in connection with FIG. 5. The other five bits of the incoming data word, comprising command bits are output in parallel at 82 from the decoder/-comparator 76 to the processor 41 as shown at the to center of FIG. 5.

Figure 5:
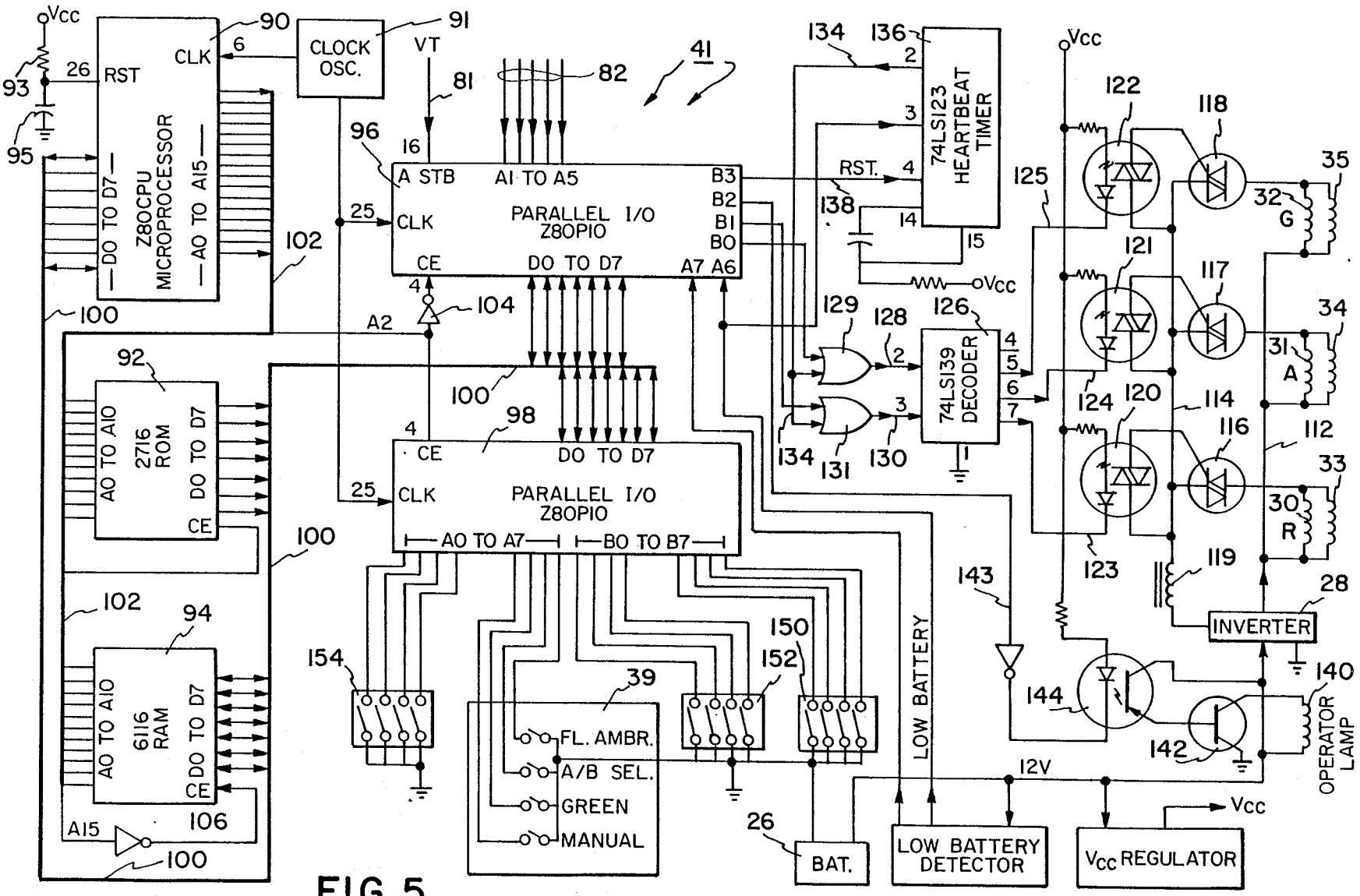
FIG. 5 is a block diagram of a signal processing and traffic controller lamp system which appears at each receiver.

Referring now to FIG. 5, showing the data-processing and traffic light control circuitry 41 which is included in each remote traffic controller unit, this circuitry includes a microprocessor system or processing decoded valid command bits 82, and gate logic circuitry for controlling the flow of power appropriately for lighting the red, amber and green traffic controller lamps. The illustrated inverter 28 is a purchased item and will not be forth described herein. The circuitry also shows an OPERATOR lamp circuit facing rearwardly of the traffic controllers and visible to the operator of the transmitter, and shows certain timers 1*d* delays. The manual control panel 39 which can be seen also in FIG. 1 is used for locally controlling the associated traffic controller unit. In addition the system shows battery condition responsive circuitry.

Still referring t FIG. 5, the processing system includes a microprocessor 90 which is a Z80 chip in the production model, a read-only memory (ROM chip 92, a random access memory (RAM) chip 94, a data input-/output (I/O) port 96, and a switch-reading input/output(I/O) port 98. These five chips have data terminals D0 through D7, all interconnected by a data bus 100. The chips also have access terminals including on the microprocessor chip Address terminals A0 through A15, and fewer such terminals on the their chips, appropriate ones of which are interconnected by an dress bus 102.

The five bit command address codes 82 coming from the receiver and decoder of FIG. 4 enter FIG. 5 near the top center thereof and enter the data I/O port 96 at its A1 to A5 terminals. The data I/O port 96 is initialized to interrupt the microprocessor 90 whenever it receives a command character on its inputs 82 from the receiver, which character is accompanied by a VALID transmission signal 81, thereby transferring the command signal 82 from the transmitter to the microprocessor, which transfer stores the command word 82 in the RAM for processing.

The I/O port 96 is initialized by the software in the ROM at power-up such that its port-A becomes an input port and its port-B becomes an output port. Likewise, at power-up the I/O port 98 is initialize so that both of its ports become input ports to deliver switch data to the microprocessor 90. The microprocessor address bits A0, A1 and A2 are used to select which I/O port is being accessed A2 directly selects I/O 98 but selects I/O 96 through the inverter 104. Al selects between data transfer and initialization options, and A0 selects between port-A and port-B of whichever I/O has been selected by A2. When selections have been made by these address signals, data is transferred via the data bus 100 when the microprocessor 90 reads from or writes to these I/O ports.

Data is processes according to the program contained in the ROM 92 in the manner to be hereinafter described in connection with the computer program flow diagram, FIG. 6. Microprocessor 90 enables the ROM 92 by a signal taken from its A15 terminal and delivered to the terminal of the ROM 92, whereupon the ROM interacts with the microprocessor 90 via the address terminals A0 through A10 and via the data terminals D0 through D7 to deliver the corrct instruction from the ROM to the microprocessor 90 to process the data from the data I/O 96. The microprocessor 90 while processing the data also interacts with the RAM 94 via its address terminals A0 through A10 and its data terminals D0 through D7, and enables the RAM 94 at appropriate times via the address line A15 connected through an inverter 106. Since the A15 is used to enable both the ROM 92 and the RAM 94, the presence of the inverter 106 in the RAM line causes the microprocessor to enable the RAM when the ROM is disabled, and vice vesa. A clock oscillator 91 clocks the CLK terminals of the micrrocessor 90 and the two I/O 96 and 98 in the usual manner. The reset terminal RST of the microprocessor is connected by a resistor 93 to the operating voltage terminal Vcc, and a capacitor is connected to ground, whereby, during power-up, a low is momentarily held on the RST terminal which results in resetting microprocessor and holding it reset until the capacitor 9 charges through the resistor 93. The steps by which the mioprocessor, the ROM, the RAM and the two I/O chips interact will be described more fully when discussing FIG. 6 which shows the flow of the program supplied by the ROM.

The diagram of FIG. 5 further shows the traffic lamps which are to be controlled. They include, as also shown in FIG. 1, the red lamps 30 and 33, the amber lamps 31 and 34, and the green lamps 32 and 35. These three pairs of lamps are connected on one side to an AC line 11 coming from the inverter 28, the other AC line 114 being coupled to corresponding triacs which are referenced 116 for the red lamps, 117 for the amber lamps, and 118 for the green lamp. The AC line 114 is coupled to the inverter through an instance 119 which rounds the waveform from the inverter making it easier for the triacs to switch, as is well known in the art Opto-isolators 120, 121 and 122 isolate the gates of e triacs and the higher voltage appearing across the triacs from the low voltage electronics which control the gates to protect e latter in case of a breakdown in a triac gate circuit. The opto-isolators are in turn controlled by wires 123, 124 and 125 which are connected to three of the four outputs of a binary doder 126 which has two inputs 128 and 130, and which decode their levels to obtain the outputs to the opto-isolators on wires 123, 124 and 125. The inputs to the decoder 126 are respecively derived from the output on wire 128 of the OR gate 129 an from the output on wire 130 of the OR gate 131. The inputs t these OR gates also include one common input on wire 134 whose purpose will be discussed hereinafter.

In addition, the input to the OR gate 129 include an output from the B0 terminal to the data I/O port 96, and include to the OR gate 131 an output rom the B1 terminal of the I/O port 96. The binary states of these two outputs from B0 and B1 are controlled by the microprocessor and the ROM program, and set binary control level outputs on wires 128 and 130 to determine which of the three groups of lamps is lighted at any particular moment.

The input wires 13, 124 and 125 to the opto-isolators are normally high to keep ne associated traffic control lamps extinguished. When one of these wires goes low the associated lamp is lighted through its enabled triac. Referring further to the decoder 126 and the OR gates 129 and 131, the decoder has two control wires 128 and 130. Thinking of the outputs of the decoder 126 as normally high, i.e. all lamps extinguished, according to the truth table for this decoder 126, which is a 74LS139, it takes highs on both control wires 128 and 130 to make the red control wie 123 go low at the output of the decoder 126. It takes a high on input wire 128 and a low on input wire 130 to make the amber control wire 124 go low and energize its associate lamps, and it takes a low on input wire 128 and a high on input wire 130 to make the green control wire 125 go low and energize it associated lamps. The appropriate combinations of high (H) and low (L) inputs to the OR gates from the I/O terminals B0 ad B1 are determined by the microprocessor 90 through the data terminals to the I/O port 96, i.e. these inputs being either LL for red, H1 for amber or LH for green as determined by the program.

The function of the wire 134 is to force illumination of the red lamp if the heartbeat timer 136 times out. The duration of this timer is controlled by a resistance-capacitance time constant attached to the chip at its pins 14 and 15. The chip 136 is continuously trying to time out, but is reset periodically during each passage through the main loop of the ROM program by a pulse on wire 138 from the microprocessor 90 through the B3 terminal of the I/O 96. This pulse occurs multiple times each second and keeps the timer chip 136 from timing out, whereby no change of level on the line 134 occurs to affect the decoder 126. However, if something happens to the microprocessor and it ails to cycle and periodically provide resets on wire 138, the timer 136 will time out and place a high on wire 134, which will drive both OR gate outputs 128 and 130 high, whereby to force the red light condition at this traffic controller. Such checking of the cycling of the microprocessor makes the traffic control system fail-safe for failures of the local microprocessor.

It will be recalled that in connection with the description of FIG. 4, each time that a character code is received from the transmitter at the receiver, and its system address bits check, a VALID transmission signal VT is output on wire 81 from the inverter amplifier 80, indicating that the character received is intended for this traffic control system instead of some other system. This VT signal 81 is input into the I/O chip 96 at terminal 16. When the VT signal is absent, however, it indicates that no transmission is being received by this remote controller unit which is directed specifically to it and is valid to control its condition. When loss of command occurs, a 12 volt OPERATOR indicator lamp 140 is flashed. This lamp is located on the rear surface of one of the controller housings 36 or 38 so that it is visible to the operator of the transmitter. In FIG. 5, this lamp is controlled by a power transistor 142, which is coupled through an opto-isolator 144 via the wire 143 with the B2 terminal of the I/O chip 96. This wire 143 is intermittently enabled by the microprocessor when the VT signal fails. The wire 143 is also intermittently enabled to flash the lamp 140 when an ERROR code is received from the receiver via the data lines 82 to the I/O port 96, indicating to the operator that he should re-send his COMMAND code, i.e. this time without pushing two transmitter buttons. The wire 143 is also continuously energized to show a continuous light from the OPERATOR lamp 140 whenever the green lamps are energized to confirm their energization to the transmitter operator.

The other I/O port 98 reads four groups of switches and delivers binary signals corresponding thereto to the microprocessor. One group of these switches is mounted on a switch panel 39 which is located at each remote controller unit. This switch panel has four switches on it. One switch is an A/B SELECT switch which is to be preset by the operator to determine whether this remote controller unit will be responsive to A or to B COMMAND codes. A FLASH AMBER switch appears on the panel 39, and when ON, overrides all other control functions at the associated remote controller unit and causes continuous flashing of the amber lamps 31 and 34. When this switch is ON, a COMMAND code received from the transmitter is ignored and the positions of the other above mentioned switch panel switches are also ignored. A MANUAL switch also appears on panel 39, and when actuated permits the associated remote controller unit to be manually controlled, as distinguished from controlled by the transmitter whose commands are then ignored. The fourth switch is a GREEN switch, which when the MANUAL switch is actuated, will change the normally ON red light mode to a green mode which persists as long as the GREEN switch is actuated. This switch can be a push button on an extension cord plugged into the switch panel 39 for operator convenience. The actuation of the GREEN switch while the controller unit is in the MANUAL mode, is locally equivalent to receiving a GREEN command from the transmitter.

The other three groups of switches associated with the I/O port 98 include three groups of four DIP switches each. These include DIP switches 150 which can be set to enter a four bit binary code in parallel into the I/O 98 which it reads out to the microprocessor 90 to determine a minimum dwell time for the red lamp control signal to remain ON, that is, how long the red lamps 30 and 33 must remain illuminated before they can be changed to the green mode by a transmitted COMMAND. The DIP switch group 152 similarly can be set to determine a minimum dwell time for green lamp illumination, i.e. a time which must elapse before the lamps 32 and 35 can be extinguished to exit to the amber mode. The remaining DIP switch group 154 can be set to establish the minimum dwell time that the amber lamps must remain energized before they turn off and the system cycles automatically to the red mode. The minimum permissible durations for these dwell times are specified in the MUTCD manual as discussed near the beginning of this specification. In addition, the red lamp dwell time set by the DIP switches 150 can be deliberately lengthened to allow sufficient time for all vehicles to clear a one-lane detour before the traffic can be admitted from the opposite direction. The outputs of all of these four switch groups are fed into the terminals A0 to A7 and B0 to B7 of the I/O port 98 and their respective binary positions can be read out to the microprocessor 90 by the I/O 98 through its data terminals D0 to D7 when called for by the microprocessor.

The condition of the battery 26 is monitored by amplifier means operating as comparators which monitor to detect a low battery level and a dead battery level, and the outputs are fed into the input terminals A6 and A7 of the I/O port 96. If the battery is dead then the heartbeat timer 136 is cleared to turn on the red lights through line 134 regardless of any outstanding commands or entries in the table of variables. If the battery is merely low, this fact is presented to the port terminal A7 for detection.

Figure 6B:
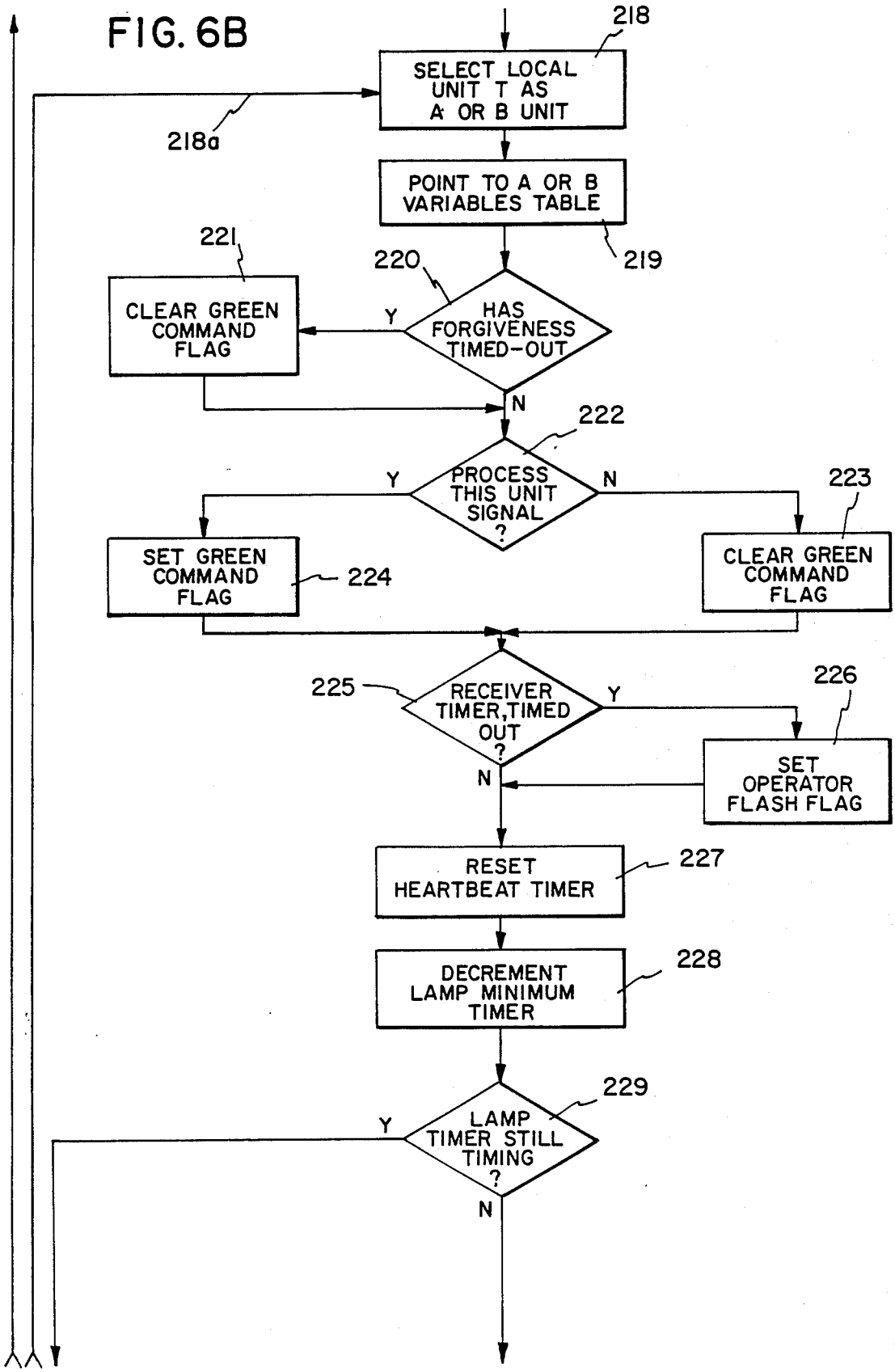
Figure 6C:
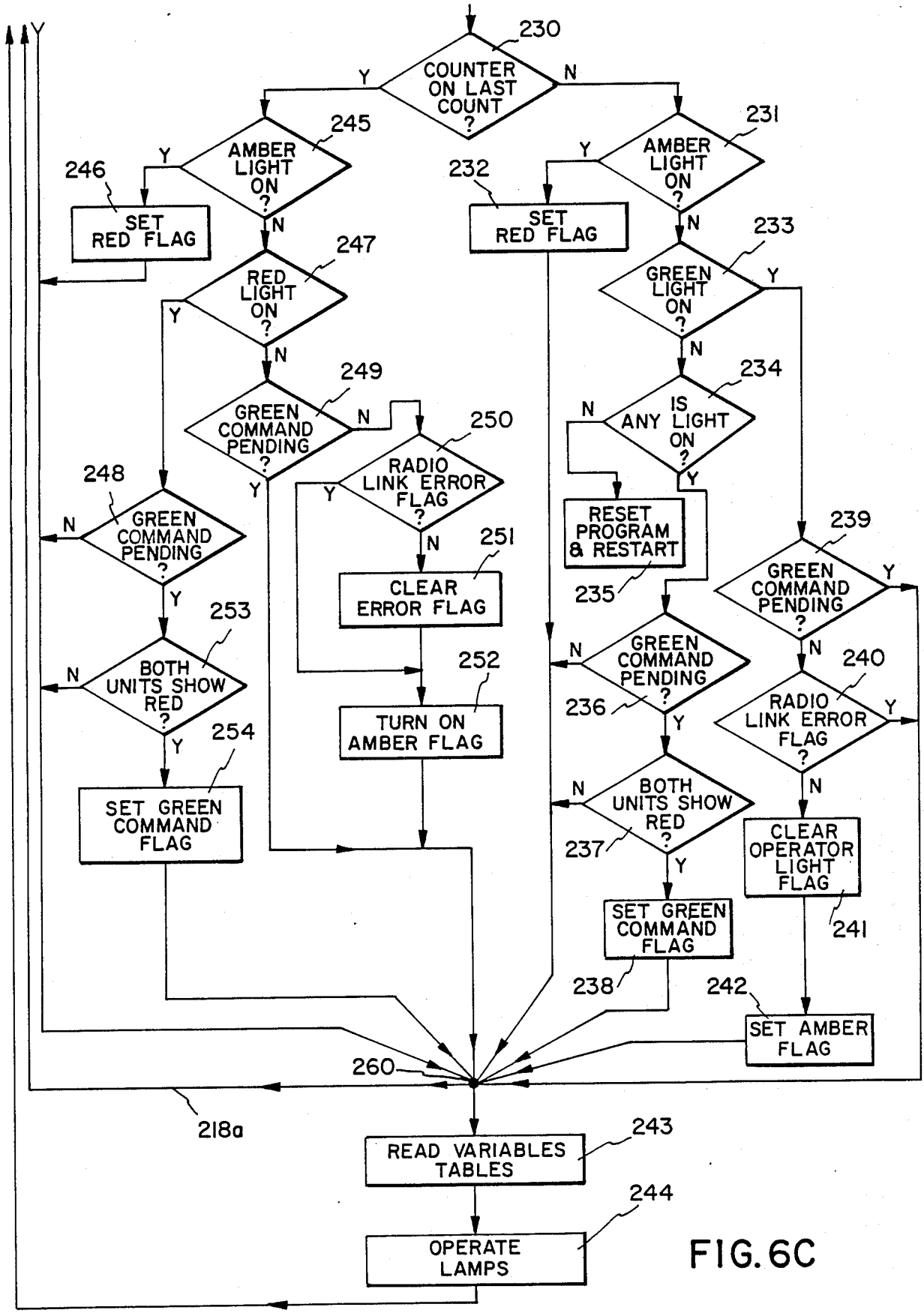

Referring now to FIG. 6A, 6B and 6C, these figures form a composite figure which shows a flow diagram for a microprocessor program which is taken from the ROM 92, and indicates the order in which commands and decisions are made during each cycle of the program, which recycles about once every 400 milliseconds. The logic flow begins when power is applied to the system by means of an ON switch 200. After power-up, the system is stabilized and tested and reset before it begins executing the logic in a main repeating loop extending from the block 206 to the block 244 which will be discussed hereinafter.

Referring first to FIG. 6A, the program runs system self-tests in step 201 by adding all of the bytes in the ROM to check for a valid sum. Then it writes to, and reads from, each RAM 94 location twice with sequentially increasing byte values. Then it writes to, and reads from, each I/O chip 96 and 98. In this way the microprocessor 90 accesses all computer chips to test the integrity of the hardware. If any errors are found in step 201*a*, then the microprocessor 90 hangs up in an endless loop shown at 202, and at the same time the system defaults to a continuous red light display.

If no hardware error is found, the program continues by initializing the hardware in step 203. First, each I/O port 96 and 98 is initialized. The I/O port 98 which reads the switches on panel 39, and switches 150, 152 and 154 is initialized as two input ports, which are accessed periodically by the microprocessor 90 to read the switch values. Also during the initializing hardware step 203, the system reads the A/B switch to determine whether this receiving unit is an A or a B unit. It stores this determination as a variable in RAM and refers to it at step 217 by reading this variable. The data I/O port 96 is initialized to have one input port-A to receive data on data lines 82, and one output port-B to control the lamp driver circuitry. When data is received, it includes both an address and a digital character which arrives on lines 82, and the I/O port 96 interrupts the microprocessor 90 whenever the address compares properly in the comparator 76 with the address DIP switches 78 so that the circuit delivers a valid transmission signal 81 to the I/O 96, indicating that this transmission is addressed to receiving units which are in this particular controller system as distinguished from another system at a different location. The microprocessor 90 responds by storing the last character appearing at the input port-A in a RAM 94 memory location designated as LAST CHARACTER, and by setting a READY flag in RAM, as will be discussed in connection with program step 211 hereinafter.

After completing the hardware initialization step 203, the program proceeds into a series of steps forming a repeating main loop beginning at step 206 and ending at step 244. For purposes of this discussion, it will be assumed that the present controller is the A unit, and that the other controller unit remote from this unit is the B unit, these designations of unit identity having been made by setting an A/B select switch shown in this embodiment as being on panel 39 although it can be located anywhere in the unit. Both units receive all of the transmitted signals, which can include a green COMMAND signal addressed to the A unit, or a green COMMAND signal addressed to the B unit, or an IDLE signal which is transmitted when neither unit is being commanded to go to a green display mode. The A unit responds to a COMMAND specific to it, when accompanied by an appropriate VALID signal 81, but it also accepts and monitors VALID commands signals specific to the B unit by storing them in its own RAM at an appropriate table of variables location designated for that purpose. Similarly, the program at the B unit responds to VALID commands specific to the B unit, but a accepts and monitors commands specific to the A unit, monitoring at each unit of the other unit's commands avoiding conflicting traffic light modes. As an example of monitoring both systems, if the transmission link is lost or interrupted, then the local system will assume the worst case, i.e. that the other unit has received a green COMMAND. When the radio link is again established, the local unit will provide a delay sufficient to allow the remote unit to finish cycling from GO to CAUTION to STOP before acting on any green COMMAND signals that may be specific to the local unit. In both systems, the microprocessor 90 maintains in the RAM a table of variables for both the A unit and the B unit. Then as each unit goes through its program, the program first reads the manual switches connected through its I/O 98, and then reads the "LAST CHARACTER" stored in the RAM system tables and sets flags which indicate the presence or absence of a command for its controller lamps. It also checks the minimum time-on timers for whatever lamps are lighted. Finally, it reads the most recent variable from its table and operates the lamps appropriately.

Still referring to FIG. 6A, just after power-up as a part of the initialization step 203, the program in step 203*a* begins by placing the lamps in the amber mode in which the amber lights are flashed for a short time, as determined by the amber timer switches 154. When the amber times out, the program in step 203*a* proceeds to the red mode which it maintains while the program proceeds down the main loop of program steps. This sequence insures safety by gaining control of any vehicles in the vicinity before any unit can go to green and allow vehicles to pass. The program then proceeds to step 204, where it reads the manual FLASH AMBER switch on the panel 39. If the switch is closed it proceeds to flash the amber lights 31 and 34 in a continuous minor loop including the steps 204 and 205 until the FLASH AMBER switch on panel 39 is opened. On the other hand, if the FLASH AMBER switch is not closed, the program proceeds to step 206.

The program proceeds as follows repeatedly through the main loop beginning at step 206. In this step the program determines whether the MANUAL switch on the panel 39 is ON. If it is ON, then the program moves to step 207 to check the panel 39 to determine if the manual GREEN light switch is ON. If it is ON, then in step 208 the memory table in RAM 94 is updated to set a last character READY flag to indicate that the green light should be turned ON, i.e. later in the main program loop at step 244 when this manual command is actually carried out. If the GREEN switch is not ON in step 207, then the minor loop rejoins the main loop at step 209 to determine whether the transmitter's last transmission was a transmitter IDLE character, indicating that the transmitter is ON but not commanding a green light condition in either controller unit, as will be subsequently discussed. If the controller MANUAL switch on panel 39 is ON but the GREEN switch on panel 39 is off, then the unit continuously shows the default red mode, and is unable to respond to any command from the transmitter, which would simply be ignored.

Returning to step 206, if the MANUAL switch on panel 39 is OFF, then the program proceeds to step 210 in which it check the RAM 94 for a VALID character flag, step 211 which interrupts the microprocessor to determine whether or not a character READY flag has been set, indicating that a VALID character has been received from the transmitter. This could be either a green COMMAND character with a valid transmission VT indicating a command which is specifically addressed to the local controller unit of this system, assumed to be the unit A; or it could be a green COMMAND addressed to the other remote unit B; or it could be an transmitter IDLE character, i.e. the transmitter is on but the operator is not sending any command signal. If any of the above characters was received and stored as a LAST CHARACTER, then the program proceeds to step 209 to ask whether the LAST CHARACTER was an IDLE character. If in step 209 the last character was an IDLE character, then step 215 resets a receiver timeout timer in RAM, which would time out if no VALID signal were received from the transmitter within the duration of its delay. If this occurs, then at the same time the forgiveness counter in RAM is also decremented one count, and the program returns to the main loop above step 217. The decrementing of the forgiveness counter is done because the operator may have accidentally slipped his finger from the command button he was holding down, causing the command to temporarily disappear. If he places his finger again on the button before the forgiveness counter times out, the commanded control unit will not have changed from a green light mode because of his slip. If the forgiveness timer times out, the system will automatically cycle from green to amber to red. If in step 209 the last received character was not an IDLE character, then the system proceeds to step 214 to determine whether the LAST CHARACTER was a green COMMAND character for this unit, accompanied by a valid transmission VT signal was received on wire 81. If yes, then the forgiveness counter is reset in step 216 to begin counting all over again if the green COMMAND signal should again be lost, and a green FLAG is set and the program returns to the main loop.

Going back to step 206, if the panel 39 MANUAL switch is not ON, and there has been no character received from the transmitter, i.e. no READY flag has been set in step 210, then the program proceeds to step 212 to check whether the receiver timer 136 has timed out. If not, then the main loop of the program resumes, but if it has timed out then the program goes to step 213 in which an ERROR flag is set, which later in the program at step 240 causes the operator warning lamp 140 to flash indicating loss of signal from the transmitter.

As stated above, the programs runs the main loop repeatedly, also checking each time to determine whether the panel 39 switches are set to override transmitted signals and if so to determine which lights should be lighted, and to monitor the radio link to determine whether a new LAST CHARACTER has been received and if not whether the receiver timer has timed out yet.

At the conclusion of any one of the steps 212, 213, 214, 215 or 216, the program goes on to step 217, FIG. 6A, where it reads the variable stored at step 203 to determine which unit this is, A or B.

The microprocessor 90 continues through the next portion of the program shown in FIG. 6B. In step 218 it calls the processing of variables either for the A or the B unit, this selection being changed each time through the steps extending from 218 to the point 260, FIG. 6C, once for each receiving unit of the system. In step 219 it points to the RAM table of variables for the unit called in step 218.

The table of variables in RAM actually includes several different tables. The first is a table shared by information for all units. It includes STACK, a start code variable; CHR READY, a flag; LST CHR, the last character received; MISSED, radio link downcounter; FORGIV, the forgiveness counter; UNIT, i.e. is this an A or a B unit; DOING, which unit's variables are being serviced; ALL RED, a flag indicating all units in red mode; ADDRESS, unit A or B; and IX, an instruction to begin processing variables for the next unit. In addition, there is a table of five variables for each of receiving units, including CUR CLR, current color (mode); LIT TIME, light timer; COMMD, pending command; PENDING, flag for green mode; FLAG, flag stored by program; and IX1, and indication to go to processing variables for the B unit. The variables for the B unit table would be the same except that the last variable would be IX0, instruction that the next processing should be for the A unit begin processing for the A unit.

At step 220 a check is made to determine whether the forgiveness counter has counted out. If so, in step 221, the green command FLAG which was previously set in step 216 is cleared, allowing this local unit to proceed to the amber mode. At step 222 a decision is made as to whether, during this time through the called processing steps, the program is processing signals for this local unit or for the remote unit, as determined in the step 218. If this time through the main loop, the program is processing transmitted signals for the local unit, then in step 224 it sets a green COMMAND flag, but if processing for the remote unit, then the local command flag is cleared in step 223.

In step 225, if the receiver counter in RAM has timed out, i.e. for failure to timely receive a transmitted signal, then the system goes to step 226 in which it sets a flag to flash the OPERATOR light 140 indicating failure of radio link, the actual flashing being picked up later in the program at step 244. If the receiver timer has not timed out, meaning that a timely transmission has been received, then the system proceeds to step 227 wherein the system outputs a pulse on wire 138 to reset the heartbeat timer 136 to begin timing again. This reset indicates that the microprocessor 90 is cycling properly and prevents the automatic cycling of the local unit to the display its red mode by putting a high on wire 134 to enable the red lamps 30 and 33 through the decoder 126, as described above in connection with FIG. 5. In step 228, the minimum timer for whichever lamp is lighted, as set by the switches 150, 151 or 152 is decremented, whereupon the program proceeds to step 229 to determine whether the minimum timer just decremented is still counting. If yes, the program jumps directly to the point 260 just above the step 243 from which it returns vial the flow line 218*a* to begin processing variables for the other unit. When both units' variables have been processed, it goes then to step 243 to continue the main loop.

Proceeding now to FIG. 6C and recalling that the present loop has been assumed to be processing for the local unit, if the light timer is done counting at step 229, then in step 230, the just decremented counter is tested to see if it is on the last count. If not, then the program jumps to step 231 to determine whether the amber light is ON. Conversely, if in step 230 the answer is yes, i.e. the zero count, and if in step 245 the amber light is ON, the microprocessor 90 then sets the red light FLAG in step 246 and then proceeds directly to re-enter the main loop at point 260.

However, if in step 230 it is not the last count, and if in step 231 the amber light is found to be ON, the program sets the red FLAG again. If in step 231 the amber light is found to be OFF, then the program tests in step 233 to determine if the green light is ON. If yes, it then tests in step 239 to find whether a green COMMAND is also pending from step 214, indicating a continuance of the green COMMAND for this unit. If yes, then the system proceeds directly to point 260 in the main loop. If not, however, meaning that the green light is ON but there is no pending green COMMAND to continue, then the system tests in step 240 to determine whether a ERROR FLAG was set in step 213, meaning loss of transmitted signal. If yes, the system proceeds to re-enter the main loop at point 260. If not, then the OPERATOR FLAG will be turned OFF at step 241 and the amber flag will be set at step 242, and the program will re-enter the main loop at point 260.

If the amber light in not ON at step 231 and the green light is not on at step 233, then the program in step 234 tests whether any light, i.e. red, is ON. If not, then the program is fully reset at step 235, and begins to initiate again at step 201. If at step 234 the red light is ON, the program proceeds to step 236 to determine whether a green COMMAND is now pending. If not then it re-enters the main loop at point 260. If a green COMMAND is pending at step 236, and if both units are showing red at step 237 according to the variable tables in RAM 94, then the system sets a green command FLAG at step 238 and re-enters the main loop at point 260.

Returning to step 230, if the light timer for the lamp presently illuminated has reached zero, then the system proceeds down the flow diagram to determine which lamp should be illuminated next. It first tests at step 245 to determine whether the amber light is now ON. If so, then it sets a red flag in step 246 since the amber light is about timed out. If not, then the program proceeds to step 247 to find if the red light is ON. If yes, it checks in step 248 to determine if there is a green COMMAND pending. If the red light is not ON at step 247, then the green light must be ON, and the program proceeds to step 249 to determine whether a green COMMAND is pending. If yes, the program then continues the loop beginning at step 218 and ending at step 260 for the other unit. If there is no green COMMAND pending at step 249 then the program proceeds to step 250 to determine whether a radio link ERROR FLAG was set in step 213, meaning loss of transmitted signal. If not, the program proceeds to step 251 to clear any ERROR FLAG calling for flashing of the OPERATOR LAMP, and then proceeds to step 252 to set the AMBER FLAG. If an ERROR FLAG if found to be set in step 250, the system proceeds directly to step 252 to set the AMBER FLAG to begin the process of proceeding automatically to the red mode through the amber mode. At step 252 the program re-enters the main loop at point 260.

Going back to step 247, if the red light is ON, then the program tests to determine whether there is a pending green COMMAND. If yes, then from 248 it proceeds to step 253 to determine if the lights in both A and B units are red. If not then it re-enters the main loop, but if both units are showing red, and there is a local pending green COMMAND, then it sets the green command FLAG at step 254 and re-enters the main loop at point 260.

Each time through the main loop of the program from step 206 to step 244, the portion of the loop from 218 to the point marked 260 is performed multiple times sequentially, once for processing variables for the local unit and a subsequent time, or times, for processing variables for a remote unit, or units. The line 218*a* on the flow diagram schematically indicates repetition of the minor loop 218 to point 260 for as many remote units as may exist in a system. If there are more than two units, i.e. a unit C, then the processing of variables for the unit C would also be called before the program would proceed to complete the main loop from point 260 through step 244. When the variables for each passage through the loop have been processed, and stored in the tables, then the steps 243 and 244 are performed for the local unit only, and the program lights the appropriate lamps for the local unit. This is accomplished by the microprocessor 90 writing to the I/O port 96 the appropriate binary outputs to appear at the port terminals B0 and B1 leading to the gates 129 and 131 to actuate the decoder 126 to operate the appropriate lamps.

This invention is not to be limited to the exact embodiment described and shown in the drawings, for changes may be made therein within the scope of the following claims.

We claim:

1. An improved digital control system for controlling the flow of traffic in selected directions in response to digital signals selectively transmitted from a common transmitting control unit to multiple separate receiving traffic control units respectively associated with each controlled direction, the improvements comprising:

(A) in the transmitting unit, a transmitter, a modulator, a digital command code generator operative when actuated to generate a character specific for each different receiving unit, and a command selector operative to select for delivery through said modulator to said transmitter a selected one of said command codes to be radiated as a digital signal;

(B) in each of said receiving traffic control units in the system:

(a) traffic control indication means operative in different modes to display to traffic flowing in a direction to be controlled multiple diverse traffic control indications;

(b) a receiver; a digital signal demodulator connected thereto and operative to deliver demodulated characters transmitted by the system's transmitting unit; a microprocessor; read only memory (ROM) means operative to program the microprocessor to process demodulated characters to produce variable indicating the operating mode of the traffic control indication means in said receiving traffic control unit and the operating mode of any of said receiving traffic control units in the system which is remote with respect thereto; random access memory (RAM) means coupled to the microprocessor and operative to receive and store said variables in tables which are specific to each of said receiving traffic control units and which represent the current operating mode of each of said receiving traffic control unit's traffic control indication means, the ROM means programming the microprocessor on each successive pass through the program to produce and store variable for a different one of said receiving traffic control units in the system, and the ROM means programming the microprocessor incident to processing variables for each of said receiving traffic control units to compare variables thereof to avoid conflicting modes of traffic control indications and then to deliver appropriate binary control outputs, and (c) said traffic control indication means being operative in response to said binary control outputs to display traffic control indications as determined by the receiving traffic control unit's variables.

2. A digital control system as claimed in claim 1, wherein the traffic control indication means includes STOP and GO mode indications, the multiple traffic control receiving units being tuned to receive all of the radiated binary signals from the system's transmitting unit, and the ROM means in each of said traffic control receiving units being operative to program its microprocessor to be responsive to a command code character specific to individual receiving traffic control units to deliver binary control outputs to set each individual receiving traffic control unit's indication means into a GO mode as long as the character is received.

3. A digital control system as claimed in claim 2, wherein the ROM means in each of said traffic control receiving units is further operative to program its microprocessor in response to the loss of a command code character specific to each individual receiving traffic control unit to delay an automatic exit of its binary outputs from the GO mode indication for a foregiveness time interval to permit re-acquisition of the command code character specific to that individual receiving traffic control unit if received again within such forgiveness time interval, the system including in each of said receiving traffic control unit a timer means settable to determine the forgiveness time interval to delay the automatic exit from the GO mode.

4. A digital control system as claimed in claim 2, wherein each receiving traffic control unit further includes a timer, and wherein the ROM means in each a receiving traffic control unit is operative to actuate the microprocessor to deliver a pulse on each successive pass through the program to reset the timer and prevent it from timing out; and each timer having an output which is connected to actuate said traffic control indication means to display a STOP mode indication so long as the timer remains timed out.

5. An improved digital control system for controlling the flow of traffic in selected directions in response to digital signals selectively transmitted from a common transmitting control unit to multiple separate receiving traffic control units respectively associated with each controlled direction, the improvements comprising:

(A) in the transmitting unit, a transmitter, a modulator, a digital command code generator operative when actuated to generate a character specific for each different receiving unit, and a command selector operative to select for delivery through said modulator to said transmitter a selected one of said command codes to be radiated as a digital signal;

(B) in each of said receiving traffic control units in the system:

(a) traffic control indication means operative in different modes to display to traffic flowing in a direction to be controlled multiple diverse traffic control indications;

(b) a receiver; a digital signal demodulator connected thereto and operative to deliver demodulated characters transmitted by the system's transmitting unit; a microprocessor; read only memory (ROM) means operative to program the microprocessor to process demodulated characters to produce variable indicating the operating mode of the traffic control indication means in said receiving traffic control unit and the operating mode of any of said receiving traffic control units in the system which is remote with respect thereto; random access memory (RAM) means coupled to the microprocessor and operative to receive and store said variables in tables which are specific to each of said receiving traffic control units and which represent the current operating mode of each of said receiving traffic control unit's traffic control indication means, the ROM means programming the microprocessor on each successive pass through the program to produce and store variable for a different one of said receiving traffic control units in the system, and the ROM means programming the microprocessor incident to processing variable for each of said receiving traffic control units to compare variables thereof to avoid conflicting modes of traffic control indications and then to deliver appropriate binary control outputs, (c) said traffic control indication means being operative in response to said binary control outputs to display traffic control indications as determined by the of each of said receiving traffic control unit's variables and (d) including microprocessor clocking means and wherein the traffic control indication means further includes a STOP, GO and CAUTION mode indications, said ROM means being further operative to program the microprocessor after the loss of a command code character specific to each individual receiving traffic control unit automatically to step the control outputs of the microprocessor to change from an existing GO mode indication to a CAUTION mode indication and the to a STOP mode indication, respectively, after predetermined dwell intervals timed by said clocking means, the STOP mode indication remaining until a command code character specific to an individual receiving traffic control unit is again received and demodulated.

6. A digital control system as claimed in claim 5, wherein the ROM means in each receiving traffic control unit is further operative to program its microprocessor after entering the CAUTION mode to maintain the CAUTION mode indication for a selected dwell interval; and the system including in each receiving traffic control unit timer means settable to determine the duration of the CAUTION dwell interval before exiting to the STOP mode.

7. A digital control system as claimed in claim 5, wherein the ROM means in each receiving traffic control unit is further operative to program its microprocessor after entering the STOP mode to maintain the STOP mode indication for a selected dwell interval; and the system including in each receiving traffic control unit switch means settable to determine the duration of the STOP dwell interval before exiting from the STOP mode.

8. A digital control system as claimed in claim 5, wherein the transmitting unit further includes in the digital code generator means for generating an IDLE code character; and means for automatically transmitting the IDLE code character to the multiple receiving traffic control units when no command code character is being selected to be radiated, and wherein the ROM means in each receiving traffic control unit is further operative to program the microprocessor therein in response to reception of an IDLE code character to maintain the receiving traffic control unit displaying a STOP mode indication.

9. A digital control system as claimed in claim 5, wherein the transmitting unit further includes in the digital code generator means for generating an ERROR code character; means for automatically transmitting the ERROR code character if more than one command code characters are simultaneously selected by the command selector; means at each receiving traffic control unit for displaying an OPERATION lamp visible at the transmitter unit; and the ROM means in each receiving traffic control unit being further operative to program the microprocessor in each receiving traffic control unit in response to reception of an ERROR character to flash the OPERATOR lamp.

10. A digital control system as claimed in claim 5, wherein each receiving traffic control unit includes a manual control panel including switch means to select the receiving traffic control unit identity and the command code character to which it is responsive; and including switch means to make the receiving traffic control unit non-responsive to transmitted digital signals, the latter switch means further including a switch operative to cause the traffic control indication means to continuously flash in the CAUTION mode, and a switch operative to cause the traffic indication means to continuously display a GO mode.

11. An improved digital control system for controlling the flow of traffic in selected directions in response to digital signals selectively transmitted from a common transmitting control unit to multiple separate receiving traffic control units respectively associated with each controlled direction, the improvements comprising:

(A) in the transmitting unit, a transmitter, a modulator, a digital command code generator operative when actuated to generate a character specific for each different receiving unit; a command selector operative to select for delivery through said modulator to said transmitter a selected one of said command codes to be radiated as a digital signal; and system address code means for generating and delivering to the transmitter digital address signals specific to this control system;

(B) in each receiving traffic control unit in the system:

(a) traffic control indication means operative in different modes to display to traffic flowing in a direction to be controlled multiple diverse traffic control indications; and (b) a receiver; a digital signal demodulator connected thereto and operative to deliver demodulated characters and address signals transmitted by the system's transmitting unit; local system address means including comparator means for comparing the local address means with received address signals and delivering a VALID signal when they match; a microprocessor; read only memory (ROM) means operative to program the microprocessor to process demodulated characters to produce variables indicating the operating mode of the traffic control indication means; random access memory (RAM) means coupled to the microprocessor and operative in the presence of a VALID signals to receive and store said variables which represent the current operating mode of other receiving traffic control units, the ROM means programming the microprocessor on successive passes through the program to produce and store said variable, and the ROM means programming the microprocessor to deliver appropriate binary control outputs, (c) said traffic control indication means being operative in response to said binary control outputs to display traffic control indications as determined by the receiving traffic control unit's variables and being automatically responsive to display a predetermined one of said traffic control indications upon the loss of a command code.

12. A digital control system as claimed in claim 11, wherein the traffic control indication means includes STOP and GO mode indications, the multiple receiving traffic control units being tuned to receive all of the radiated binary signals from the system's transmitting unit, and the ROM means in each receiving traffic control unit being operative to program the microprocessor to be responsive to all command code characters which are accompanied by a VALID signal and which are specific to all of the receiving traffic control units for producing and storing in the RAM means the variable indicating operating modes for all of the traffic control receiving units in the system, and to deliver binary control outputs to set its own local traffic control indication means into a GO mode as long as a command code character is received and provided another of the receiving the traffic control units is not already in the GO mode.

13. A digital control system as claimed in claim 12, wherein the ROM means in each receiving traffic control unit is further operative to program the microprocessor in response to the loss of a command code character specific to a given receiving traffic control unit to delay an automatic exit of its binary outputs from the GO mode indication for a forgiveness time interval to permit re-acquisition of the command code character specific to the given receiving traffic control unit if received again within the forgiveness time interval the system including in each receiving traffic control unit switch means settable to determine the forgiveness time interval to delay the automatic exit from the GO mode.

14. A digital control system as claimed in claim 11, wherein each receiving traffic control unit further includes microprocessor clocking means and wherein the traffic control indication means further includes a STOP, GO and CAUTION mode indications, said ROM means being further operative to program the microprocessor after the loss of a command code character specific to a given receiving traffic control unit automatically to step the control outputs of the microprocessor to change from an existing GO mode indication to a CAUTION mode indication and then to a stop mode indication, respectively after predetermined dwell intervals timed by said clocking means, the STOP mode indication remaining until a command code character specific to the given receiving traffic control unit is again received with a VALID signal and demodulated.

15. A digital control system as claimed in claim 14, wherein the transmitting unit further includes in the digital code generator means for generating an IDLE code character; and means for automatically transmitting the IDLE code character to the multiple receiving traffic control units when no command code character is being selected to be radiated, and wherein the ROM means in each receiving traffic control unit if further operative to program the microprocessor in each receiving traffic control unit in response to reception of an IDLE code character with a VALID signal to maintain the receiving traffic control unit displaying a STOP mode indication.

16. A digital control system as claimed in claim 14, wherein the transmitting unit further includes in the digital code generator means for generating an ERROR code character; means for automatically transmitting the ERROR code character if more than one command code characters are simultaneously selected by the command selector; means at each receiving traffic control unit for displaying an OPERATOR lamp visible at the transmitter unit; and the ROM means in each receiving traffic control unit being further operative to program the microprocessor in each receiving traffic control unit in response to reception of an ERROR character with a VALID signal to flash the OPERATOR lamp.

17. The method of controlling the flow of traffic in selected directions in response to signals selectively transmitted within a system from a common transmitting control unit to multiple separate receiving units having traffic control indication means which include GO and STOP indications respectively associated with each controlled traffic direction, including the following steps:

(a) transmitting signals which at any moment in time may include a code specific for a selected one of the receiving units;

(b) receiving the signals at the receiving units and recovering the currently transmitted code therefrom;

(c) processing the recovered codes to obtain at each of the receiving units multiple variables respectively indicative of the present mode of display of the traffic control indication means in each of the receiving units of the system;

(d) comparing the variables of each of the receiving units and commanding a traffic control indication at each of the receiving units which is not in conflict with the mode of any other receiving unit, and (e) controlling the traffic control indication means at all the receiving units so that such traffic control indication means will go to a STOP indication automatically upon the failure of any of the receiving units to properly receive specific codes.

18. The method as claimed in claim 17, wherein the signal codes include command characters each specific to control the traffic control indication at one of the receiving units to display a GO indication, and the method including the further step of transmitting a system address code with each transmitted signal code; and including the step of determining at each receiving unit whether a received code is accompanied by a VALID address code directed to the same system, and if so, processing the accompanying signal code to obtain indicative variables.

19. The method as claimed in claim 18, wherein the signal codes which can be transmitted include an IDLE character which is transmitted whenever no command character is being transmitted, and the method including the further step of controlling the traffic control indications at all of the receiving units in response to reception of an IDLE character to proceed toward and display a STOP indication.

20. The method as claimed in claim 19, including the further step of introducing minimum delays preventing the system at each receiving unit from exiting from its present mode to a different mode until the delay associated with the present mode has timed out; the status of the associated delays being among the variables obtained at each receiving unit for all of the receiving units in the system.

21. An improved digital control system for controlling the flow of traffic in selected directions in response to digital signals selectively transmitted from a common transmitting control unit to multiple separate receiving traffic control units respectively associated with each controlled direction, the improvements comprising:

(A) in the transmitting unit, a transmitter, a modulator, a digital command code generator operative when actuated to generate a command character specific for each different receiving unit, and a command selector operative to select for delivery through said modulator to said transmitter a selected one of said command codes to be radiated as a digital signal;

(B) in each receiving traffic control unit in the system:

(a) traffic control indication means operative in different modes to display to traffic flowing in a direction to be controlled multiple diverse traffic control indications including a STOP mode indication; and (b) a receiver; a digital signal demodulator connected thereto and operative to deliver demodulated characters based on codes transmitted by the system's transmitting unit; a microprocessor; read only memory (ROM) means operative to program the microprocessor to process demodulated characters to produce binary command outputs, and logic means connected to receive said binary command outputs, and logic means connected to receive said binary outputs and responsive thereto to deliver control outputs, (c) said traffic control indication means being operative in response to said control outputs to display traffic control indications as determined by the receiving traffic control unit's demodulated characters, and (d) means for controlling said traffic control indication means to automatically be operative to reflect STOP mode upon the loss of a command character to the receiving traffic control unit.

22. A digital control system as claimed in claim 21, wherein the traffic control indication means also includes a GO mode indication, the multiple receiving traffic control units being tuned to receive all of the radiated binary signals from the system's transmitting unit, sand the ROM means in each receiving traffic control unit being operative to program the associated microprocessor to be responsive to a command code character specific to an individual traffic control unit to deliver binary control outputs to set its traffic control indication means into a GO mode as long as the character is received.

23. A digital control system as claimed in claim 22, wherein the ROM means in each receiving traffic control unit is further operative to program the microprocessor in response to the loss of a command character specific to that unit to delay an exit of its binary outputs from the GO mode indication for a foregiveness time interval to permit re-acquistion of the command character specific to that unit if received again within that interval, the system including in each receiving traffic control unit timer means settable to determine the foregiveness interval to delay the exit from the GO mode.

24. A digital control system as claimed in claim 22, wherein each receiving traffic control unit further includes a timer, and wherein the ROM means in each receiving unit is operative to actuate the microprocessor to deliver a pulse on each successive pass through the program to reset the timer and prevent it from timing out; and the timer having an output which is connected to actuate said traffic control indication means to display a STOP mode indication so long as the timer remains timed out.

25. A digital control system as claimed in claim 21, wherein the transmitting unit includes system address code means for generating and delivering to the transmitter digital address signals specific to this control system; and wherein each receiving traffic control unit includes local address means and comparator means for comparing the local address means with received address codes and delivering a VALID signals when they match; the microprocessor processing demodulated characters only when accompanied by a VALID signal.

26. An improved digital control system for controlling the flow of traffic in selected directions in response to digital signals selectively transmitted from a common transmitting control unit to multiple separate receiving traffic control units respectively associated with each controlled direction, the improvements comprising:

(A) in the transmitting unit, a transmitter, a modulator, a digital command code generator operative when actuated to generate a command character specific for each different receiving unit, and a command selector operative to select for delivery through said modulator to said transmitter a selected one of said command codes to be radiated as a digital signal;

(B) in each receiving traffic control unit in the system:

(a) traffic control indication means operative in different modes to display to traffic flowing in a direction to controlled multiple diverse traffic control indications; and (b) a receiver; a digital signal demodulator connected thereto and operative to deliver demodulated characters based on codes transmitted by the system's transmitting unit; a microprocessor; read only memory (ROM) means operative to program the microprocessor to process demodulated characters to produce binary command outputs, and logic means connected to receive said binary command outputs, and logic means connected to receive said binary outputs and responsive thereto deliver control outputs, (c) said traffic control indication means being operative in response to said control outputs to display traffic control indications as determined by the unit's demodulated characters, and (d) each receiving traffic control unit further includes microprocessor clocking means and wherein the traffic control indication means further includes a STOP, GO and CAUTION mode indications, said ROM means being further operative to program the microprocessor after the loss of a command character specific to a given receiving traffic control unit automatically to step the control outputs of the microprocessor to change from an existing GO mode indication to a CAUTION mode indication and then to a STOP mode indication, respectively after predetermined dwell intervals timed by said clocking means, the STOP mode indication remaining until a command character specific to that unit is again received and demodulated.

27. A digital control system as claimed in claim 26, wherein the ROM means in each receiving unit is further operative to program the microprocessor after entering the CAUTION mode to maintain the CAUTION mode indication for a selected dwell interval; and the system including in each receiving traffic control unit timer means settable to determined the duration of the CAUTION dwell interval before exiting to the STOP mode.

28. A digital control system as claimed in claim 26, wherein the ROM means in each receiving traffic control unit is further operative to program the microprocessor after entering the STOP mode to maintain the STOP mode indication for a selected dwell interval; and the system including in each receiving traffic control unit timer means settable to determine the duration of the STOP dwell interval before exiting from the STOP mode.

29. A digital control system as claimed in claim 26, wherein the transmitting unit further includes in the digital code generator means for generating an IDLE code character; and means for automatically transmitting the IDLE code character to the multiple receiving traffic control units when no command code character is being selected to be radiated, and wherein the ROM means in each receiving unit is further operative to program the microprocessor in each receiving traffic control unit in response to reception of and IDLE code character to maintain the unit displaying a STOP mode indication.

30. A digital control system as claimed in claim 26, wherein the transmitting unit further includes in the digital code generator means for generating an ERROR code character; means for automatically transmitting the ERROR code character if more than one command code characters are simultaneously selected by the command selector; means at each receiving traffic control unit for displaying an OPERATOR lamp visible at the transmitter unit; and the ROM means in each receiving traffic control unit being further operative to program the microprocessor in each receiving traffic control unit in response to reception of an ERROR character to flash the OPERATOR lamp.

31. A digital control system as claimed in claim 26, wherein each receiving traffic control unit includes a manual control panel including switch means to select the unit identity and the command code character to which it is responsive; and including second switch means to make the unit non-responsive to transmitted digital signals, the second switch means further including a switch operative to cause the local traffic control indication means to continuously flash in the CAUTION mode, and a switch operative to cause the local traffic indication means to continuously display a GO mode.

32. The method of controlling the flow of traffic in selected directions in response to signals selectively transmitted from a common transmitting control unit to multiple separate receiving units having traffic control GO and STOP indication modes respectively associated with each controlled traffic direction, including the following steps:

(a) transmitting signals which at any moment in time may include a code specific for a selected one of the receiving units;

(b) receiving the signals at the receiving units and recovering the currently transmitted code therefrom;

(c) processing the recovered code at each of the units to obtain at the receiving units to which a code is specific a command which persists as long as the code is being received;

(d) initiating a receiving unit to the GO mode so long as the code persists, while returning the other units to STOP mode, and (e) changing each receiving unit to the STOP mode upon loss of any received code at all.

33. The method as claimed in claim 32, wherein each receiving unit in the system includes a CAUTION indication mode, and the method further includes the steps in each receiving unit to which the transmitted code is not specific, when already in the STOP mode, of maintaining the STOP mode, and when in a GO mode, the step of cycling through the CAUTION mode to the STOP mode.

34. The method as claimed in claim 33, including in each receiving unit the step of delaying the exit from one mode for a predetermined delay before changing to another mode.

35. A portable traffic control system for controlling the flow of vehicular traffic in selected directions comprising a transmitting control unit for selectively transmitting signals within the system, at least two separate and space receiving units having traffic control indication means which include GO and STOP indications, said transmitting unit including a transmitter having a command code generator operative when acuated to generate a signal character specific for each of said receiving units; a command selector operative to select for delivery a selected one of said command codes to be radiated as a signal, and system address code means for generating and delivering to the transmitter address signals specific to the control system, each of said receiving units having a receiver, a signal demodulator connected to said receiver and operative to deliver demodulated characters and address signals transmitted to said receiver, a local system address means including comparator means for comparing the local address means with received address signals and delivering a VALID signals when they match; means operative to process demodulated signal characters to produce variables indicating the operating mode of the traffic control indication means; means operative in the presence of a VALID signal to receive and store variables which represent the current operating mode of other receiving units, said traffic control indication means being operative in response to said variables received by the receiving unit, and said traffic control indication means being automatically responsive to display a STOP indication upon the failure of said receiving units to properly receive signal characters from said transmitter or upon a conflict with the variables of other receiving units in the system.

* * * * *